US009265325B2

(12) United States Patent
Boyé et al.

(10) Patent No.: US 9,265,325 B2
(45) Date of Patent: Feb. 23, 2016

(54) COSMETIC COMPACT WITH PIVOTING TRAY

(75) Inventors: Gail Boyé, New Hope, PA (US); Joseph R. Tuschong, Bethpage, NY (US); John A. Alongi, Garnerville, NY (US)

(73) Assignee: Avon Products, Inc., New York, NY (US)

( * ) Notice: Subject to any disclaimer, the term of this patent is extended or adjusted under 35 U.S.C. 154(b) by 367 days.

(21) Appl. No.: 12/556,100

(22) Filed: Sep. 9, 2009

(65) Prior Publication Data

US 2009/0320874 A1 Dec. 31, 2009

(51) Int. Cl.

| | |
|---|---|
| ***A45D 33/20*** | (2006.01) |
| ***A45D 33/00*** | (2006.01) |
| ***A45D 33/22*** | (2006.01) |

(52) U.S. Cl.

CPC ..... *A45D 33/006* (2013.01); *A45D 33/20* (2013.01); *A45D 33/22* (2013.01)

(58) Field of Classification Search

CPC ..... A45D 33/20; A45D 33/22
USPC ..... 206/581, 823, 766, 758, 744, 755, 757, 206/235; 132/287, 293–295, 314–315
See application file for complete search history.

(56) References Cited

U.S. PATENT DOCUMENTS

| | | | | |
|---|---|---|---|---|
| 2,465,946 | A * | 3/1949 | Velez | 132/315 |
| 5,135,012 | A * | 8/1992 | Kamen et al. | 132/294 |
| 5,163,457 | A * | 11/1992 | Lombardi, Jr. | 132/304 |
| 5,353,947 | A * | 10/1994 | Zinnbauer et al. | 220/812 |
| 5,878,878 | A | 3/1999 | Wu | |
| 6,196,405 | B1 * | 3/2001 | Kambouris | 220/4.22 |
| 6,932,220 | B2 | 8/2005 | Byun | |
| 2006/0231117 | A1 | 10/2006 | Manouglan | |
| 2007/0175893 | A1 * | 8/2007 | Fraillon | 220/23.89 |
| 2008/0000493 | A1 * | 1/2008 | Anderson et al. | 132/295 |

* cited by examiner

*Primary Examiner* — Todd E Manahan
*Assistant Examiner* — Brianne Kalach
(74) *Attorney, Agent, or Firm* — David M. Joyal; Joan M. McGillycuddy

(57) ABSTRACT

A compact for storing a plurality of cosmetics includes a tray for storing cosmetics in a first and a second side; a base having a pair of hinge pins received by the tray, the tray pivoting in the hinge from a first position making the first side accessible to a user to a second position making the second side accessible to the user.

14 Claims, 5 Drawing Sheets

COSMETIC COMPACT WITH PIVOTING TRAY

RELATED APPLICATION

This application claims priority to International Application Serial No. PCT/US08/58868 filed Mar. 31, 2008 which claims priority from U.S. Ser. No. 60/925,732 filed on Apr. 23, 2007; which is hereby incorporated by reference in its entirety for all purposes.

FIELD OF THE INVENTION

The present invention relates to containers, and in particular to containers for cosmetics that are known as compacts, and which have a pivoting tray.

BACKGROUND OF THE INVENTION

Compacts are containers that permit a user to carry cosmetics from one location to another without spillage of the cosmetics or affecting the quality of the cosmetics. Typically, these cosmetics are made of highly compressed powder or hot poured anhydrous contained in small palettes called pans and are specialized to be foundation, blush, lip stick, eye shadow, face powder, or the like. A user applies the cosmetic to their body via a small brush or like applicator.

The pans themselves are suitably sized, such as 1 inch length by ¾ inch width by ⅛ inch height, to provide the user a predetermined amount of cosmetic. Given the practical limitations of a compact to maintain its portability, the size of the compact limits the number of pans that may be provided in the compact. Thus, compacts generally only provide three or four cosmetic pans.

Understandably, users would like to have a greater choice in available cosmetics by providing additional cosmetic pans. While reducing the size of each pan and providing more pans is an option for manufacturers, users prefer that the traditional pan size is maintained and that more pans are provided in a compact of the same size.

Thus, a need exists for providing additional storage of cosmetic pans in a compact in the same limited space. A need exists for such storage to be readily accessible by the user.

SUMMARY OF THE INVENTION

These and other needs are met by the present invention.

In accordance with one embodiment of the present invention, a compact for carrying a cosmetic includes a base and a tray pivotable with respect to the base from a first position to a second position.

In accordance with one embodiment of the present invention, a compact for storing a plurality of cosmetics includes a tray for storing cosmetics in a first and a second side; a base having a pair of hinge pins received by the tray, the tray pivoting in the hinge from a first position making the first side accessible to a user to a second position making the second side accessible to the user.

DETAILED DESCRIPTION OF THE DRAWINGS

Figure 1A:
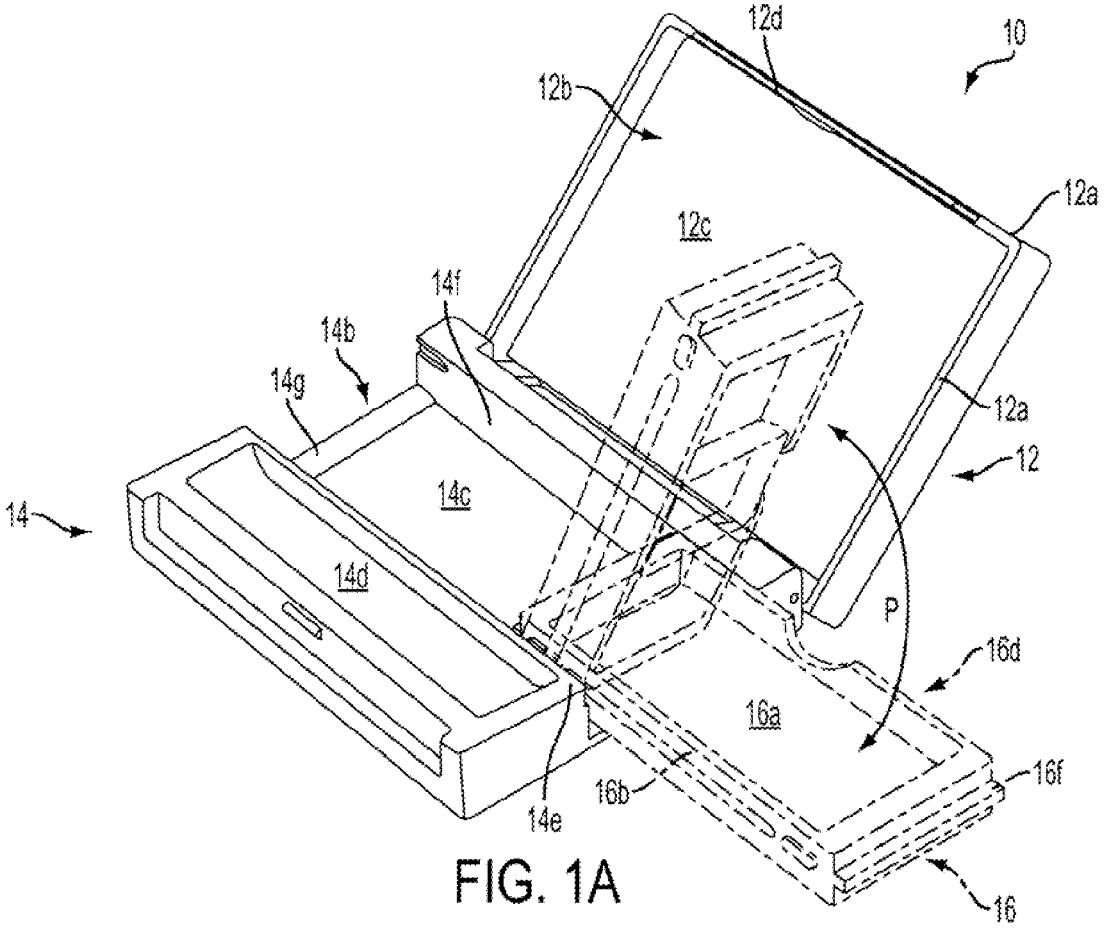
FIG. 1*a* is a perspective view of a compact of the present invention having a tray in a first position relative to the base.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, left, right, up, down, over, above, below, beneath, rear, and front may be used with respect to the drawings. These and similar directional terms should not be construed to limit the scope of the invention in any manner. The words "attach," "connect," "couple," and similar terms with their inflectional morphemes do not necessarily denote direct and immediate connections, but also include connections through mediate elements or devices.

In accordance with one embodiment of the present invention, depicted in FIGS. 1-4, cosmetics compact 10 is a container for safely carrying and storing one or more user selectable cosmetics removably mounted on one or more pivoting palettes, i.e. pan trays, along an arc P. Compact 10 comprises a cover 12 and a base 14. Like the other components of compact 10, the base and cover may be made out of any suitable durable material, such as thermoplastic resins polypropylene and/or an ABS/SAN blend and may be made as is known in the art by, for example, injection molding.

The cover and base may be connected via a common hinge 15 and form ostensibly a clamshell container and, as is generally known in the art, pivot along arrow Z from a closed to an open position or vice versa. The cover and base may also be configured to be removable from each other by pulling it apart as a box. Whether the compact is designed as a clamshell or to be opened in a box-like fashion, cover 12 preferably overlays base 14 to form a tight closure.

In plan, cover 12 comprises a substantially rectangular shape. The exterior may have a smooth surface and/or may be marked discreetly with a brand identification. One or more upright walls 12*a* are disposed on one or more peripheral edges to define an inner space 12*b* that matches with the base to form an inner space of the compact. Inner space 12*b* may include a mirror 12*c* for the convenience of the user of the compact.

One or more upright walls are extended to form a proximal protruding wall 12*d* that latches to secure the cover to the base. Similarly, a distal upright wall is extended to form a distal wall 12*e* that on the side facing the exterior includes one or more openings for receiving at least a portion of the common hinge.

Figure 2A:
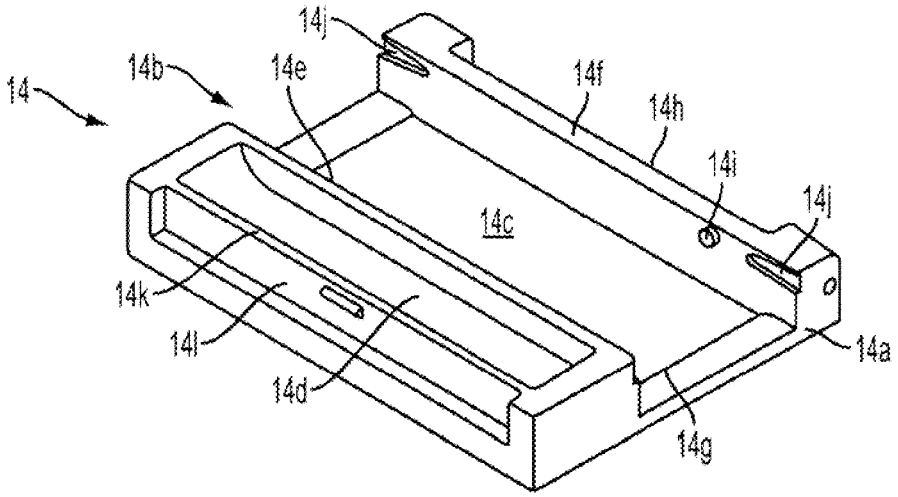
FIG. 2*a* is a perspective view of a base in accordance with one embodiment of the present invention.
Figure 2B:
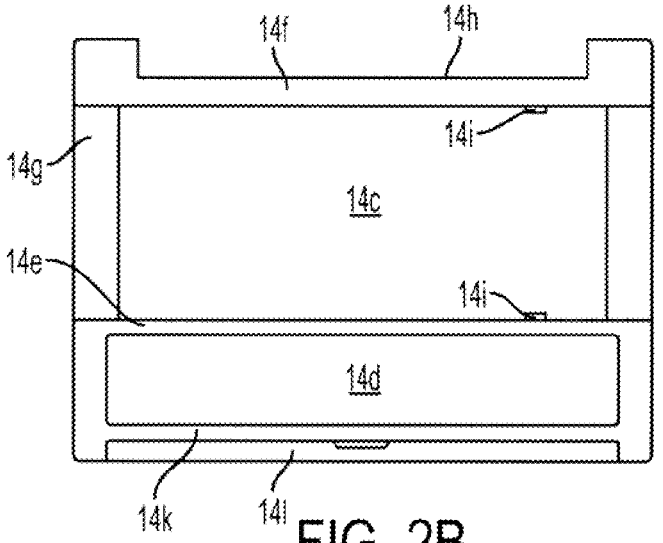
FIG. 2*b* is a plan view of the base of FIG. 2*a*.
Figure 2C:
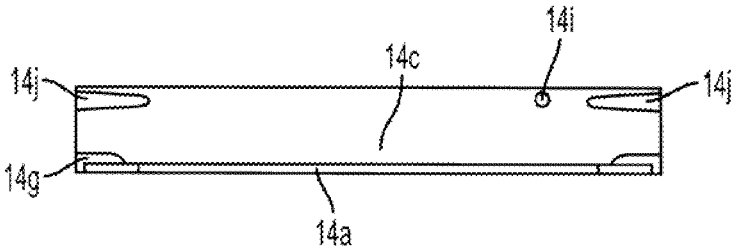
FIG. 2*c* is a cross-sectional view of the base of FIG. 2*a*.

As seen in FIGS. 2*a*-2*c* as well as in other figures, in plan, base 14 comprises a substantially rectangular shape. A plurality of peripheral and intermediate upright walls extend from a floor 14*a* to define a combined inner space 14*b* of the base. The inner space includes a bed 14*c* for storing the tray and, if so desired, a shelf 14*d* for storing one or more accessories (not shown), such as brushes useful for applying the cosmetics to the body of the user.

Bed 14*c* is oriented substantially parallel to the common hinge and is flanked by an intermediate upright wall 14*e* forming a wall for the shelf and an exterior upright wall forming a distal wall 14*f*. The bed is open at each end to the exterior and each of which may include a ledge 14*g* that ramps up from the bed to the exterior to provide a smooth transition for the tray.

On the side facing the exterior, distal wall 14*f* includes one or more openings for receiving at least a portion of the common hinge. That face of distal wall 14*f* includes an outside recess 14*h* to receive at least a portion of distal wall 12*e* when the compact is closed.

Each of the intermediate upright wall 14*e* and the side of distal wall 14*f* facing bed 14*c* include matching pair of recessed guides 14*j* for limiting movement of pan tray 16 relative to the base and protruding pins 14*i* for permitting pan tray 16 to pivot relative the base. Of course, guides 14*j* may be formed as protrusions and/or pins 14*i* may be formed as recesses. Pin 14*i* may be formed to have any suitable or convenient shape.

Shelf 14*d* is configured as a recess in a platform formed between intermediate upright wall 14*e* and a proximal upright wall 14*k*. The depth of the shelf preferably is suitable for one or more accessories useful to the user and/or may be used for any other object or cosmetic.

Wall 14*k* may include a recess 14*l* for receiving proximal wall 12*d* when the compact is in the closed position. To secure the cover and the base in the closed position, walls 12*d* and 14*k* may include a latch and protrusion assembly as is known in the art and/or may be secured by any other means.

Figure 3A:
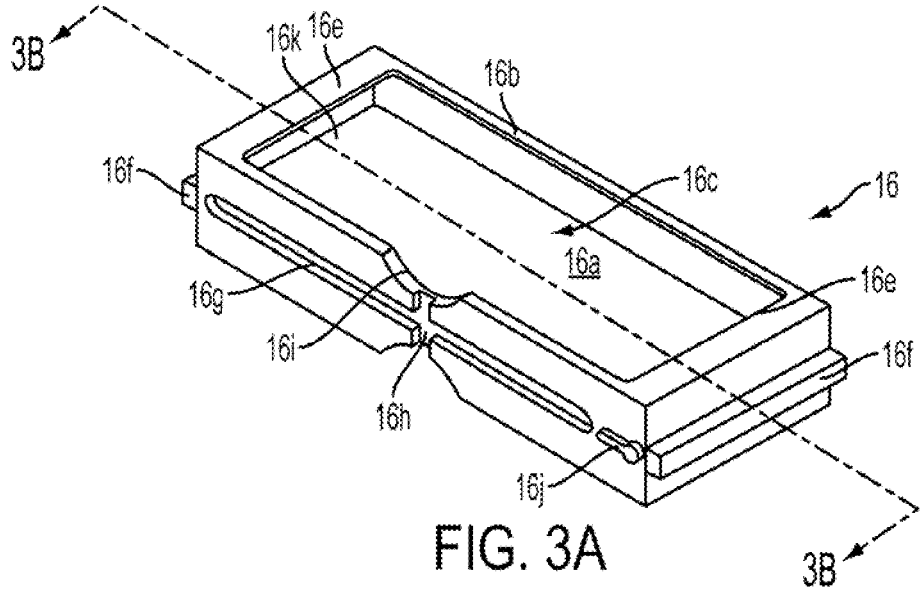
FIG. 3*a* is a perspective view of a tray in accordance with one embodiment of the present invention.
Figure 3B:
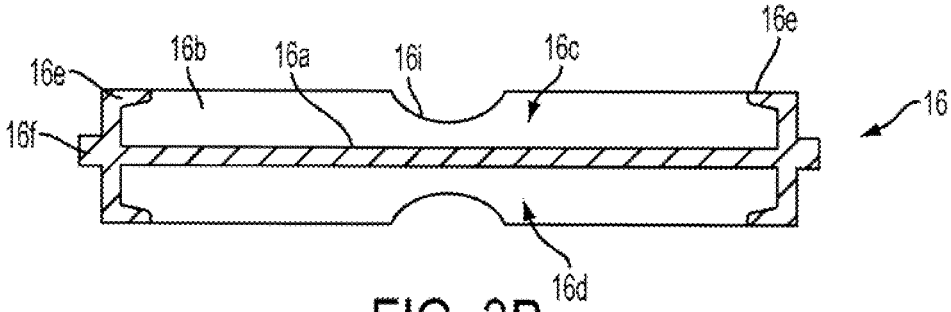
FIG. 3*b* is a cross-sectional view of the tray of FIG. 3*a*.
Figure 4A:
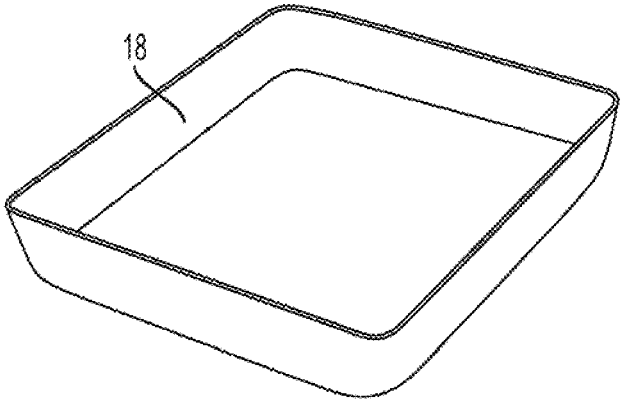
FIG. 4*a* is a pan as is known in the art.
Figure 4B:
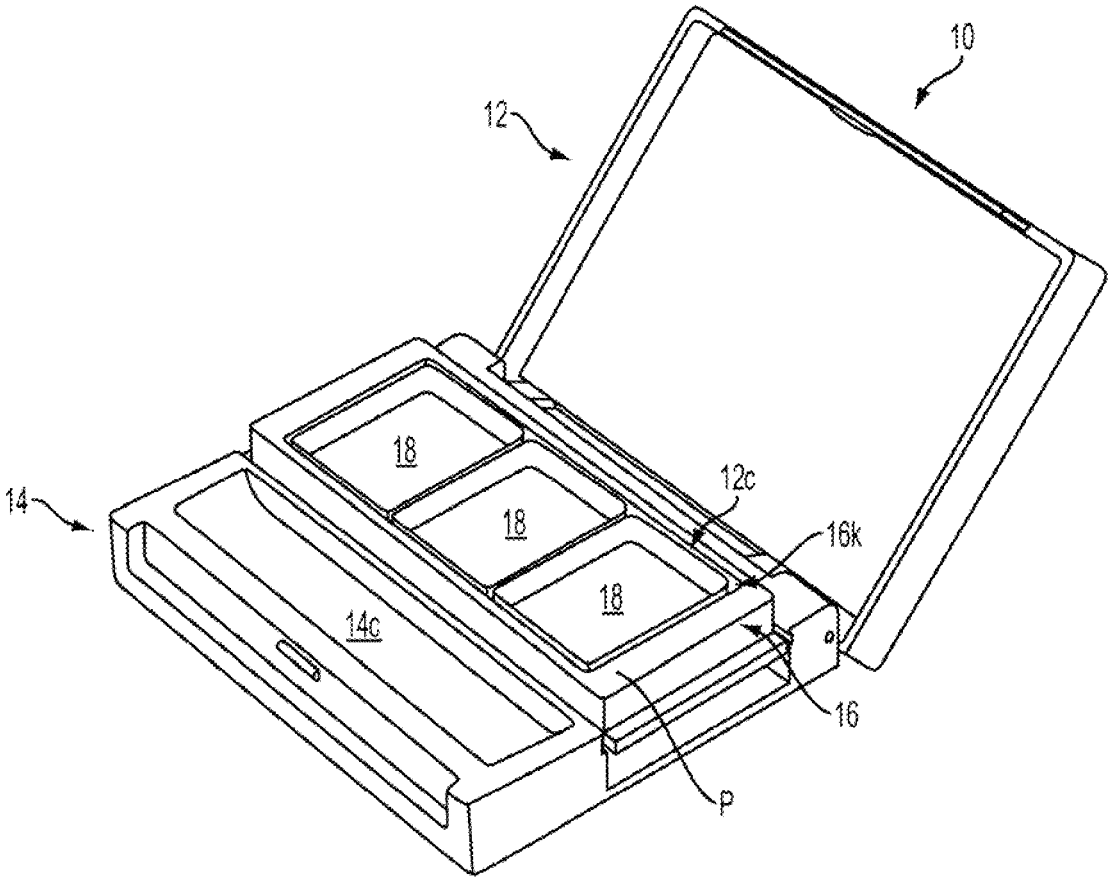
FIG. 4*b* is a perspective view of a tray holding a plurality of pans in accordance with one embodiment of the present invention.

As seen in FIGS. 3*a* and 3*b* as well as in other figures, in plan, tray 16 comprises a substantially rectangular shape having a longitudinal axis A-A and transverse axis B-B. Tray 16 pivots about a transverse axis formed between a pair of pins on each side of the tray to provide user access to one or more cosmetics stored on opposing sides of the tray. After pivoting of the tray, tray 16 is movable longitudinally from a first position to a second position to be secured in the base.

The tray comprises a common floor 16*a* and upright peripheral walls 16*b* extending from the floor to form a first and a second inner space 16*c*, 16*d* configured as compartments on opposed sides of the floor. Preferably, each inner space is sized to store one or more cosmetic pans 18 and, in turn, the pans are suitably sized to fit in one or both of the compartments 16*c*, 16*d*. So that a user may choose cosmetic suitable for them, the pans are preferably removably mountable, as further discussed below.

To secure the pans, the upright walls may comprise one or more overhangs 16*e* and to permit easier handling handles 16*f* are provided at each longitudinal end.

To be movable in the bed relative to the base, tray 16 is slightly smaller in width than the width of the bed. To retain the tray securely in the compact when the compact is closed, preferably, one or more portions of upright walls 16*b* comprise a height and are disposed sufficiently close as to be restrained by upright walls 12*a* of the compact.

A recessed rail 16*g* is provided on each longitudinal side so that a respective pin 14*i* is movably received in the rail. Preferably, the rail permits the tray to move longitudinally relative to the base when either inner space is accessible to the user and to pivot the tray relative to the base from a first position wherein the first inner space of the tray is accessible to the user to a second position wherein the second inner space of the tray is accessible to the user.

The rail is preferably situated to optimize inner space of the compact that is needed for the tray. Thus, rail 16*g* is located substantially equidistant from the longitudinal edge of the closest pair of peripheral walls and comprises an end location sufficiently proximal to an edge of the tray that provides one or more points at which the tray can be pivoted relative to the base without obstruction about an axis formed between the respective pins 14*i*.

To permit assembly and disassembly of the tray into base 14, a gate 16*h* is provided on one or both longitudinal side of the tray. The gate comprises an opening preferably in the form of a slot that perpendicularly intersects the rail.

Thus, tray 16 may be assembled by worker by inserting pin 14*i* directly into one rail 16*g* while holding the tray angularly with respect to the base. A second pin on the opposing longitudinal side can then be slid into the gate while the worker reduces the angle of the tray until the pin can be placed into the rail and moved from the area of the rail that is intersected by the gate.

To permit easy removal and/or mounting, one or more peripheral walls may include an access 16*i* in the form of a cut-out suitable to provide access to a user's finger. Preferably, the access is located proximal to the gate.

Tray 16 further includes a key 16*j* on one or both longitudinal sides for engaging guides 14*j* to limit longitudinal of the tray. Preferably, key 16*j* is formed to have linear shape and is co-linear with the rail.

In accordance with one embodiment of the present invention, floor 16*a* may be magnetized or a magnetic material 16*k* may be temporarily or permanently applied to one or more sides of the floor to removably mount the cosmetic pans to the floor in compartment 16*c*, 16*d*. Magnetic mounting is especially advantageous since the pans are typically made of metal to withstand the pressing of the powder to make the cosmetic.

The pans may also be mounted via snap-fit, weak-bonding glue, and/or other means to the floor. Furthermore, in one or more embodiments, the pans may be removably secured in inner spaces 16*c*, 16*d* to and/or between upright walls 16*b* by friction-fit, gluing and/or any other means. Consequently, common floor 16*a* may not be necessary.

In use, a consumer who desires to apply a cosmetic to their body may open compact 10 by prying the latch open or pressing on the base to release the latch and with it cover 12. The compact is opened as is known in the art by rotating the cover relative to the base along the hinge.

The user is then presented with one or more cosmetic pans in inner space 16*c* of tray 16. If the pans are removably mounted, the user may have selected and mounted the pans in tray 16 themselves. In addition or instead of, the user may have mounted preloaded trays using the assembly procedure as described above.

Therein, tray 16 typically comprises three pans of substantially equal size are provided. However, more or less pans or a plurality of differently sized pans may be provided. If the user finds that the pans are insufficient, further pans are provided on the opposite side of the tray in inner space 16*d*.

Figure 1B:
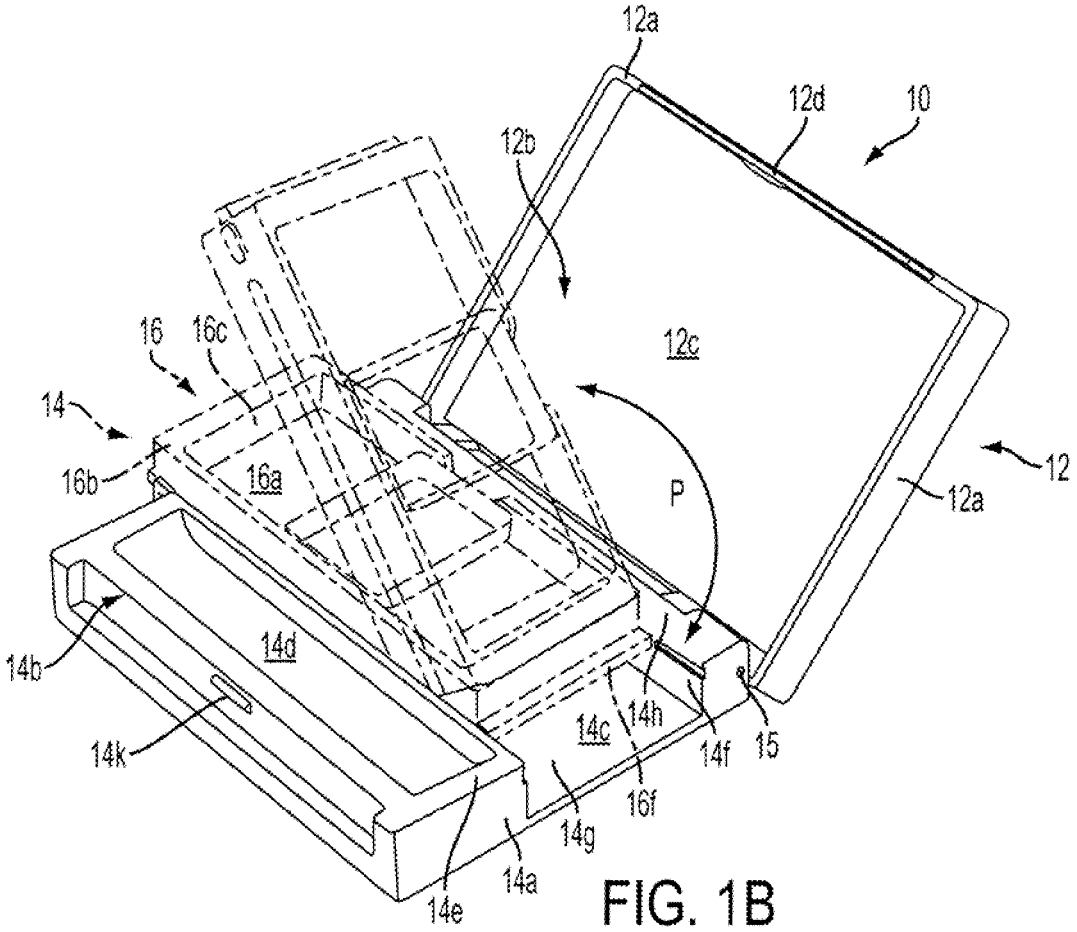
FIG. 1*b* is a perspective view of the compact of FIG. 1*a* having the tray in a second position relative to the base.
Figure 1C:
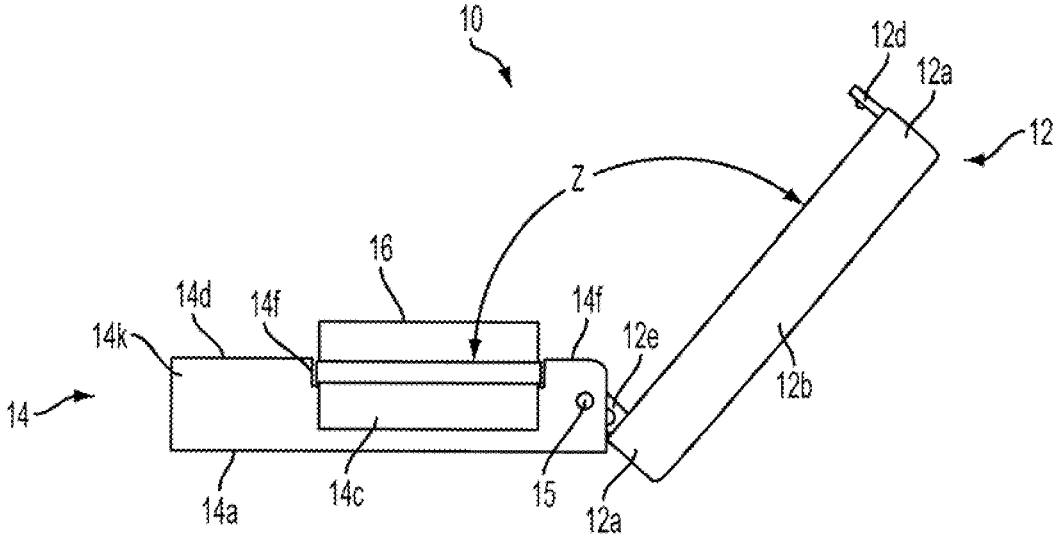
FIG. 1*c* is a side view of the compact of FIG. 1*a*.

To access inner space 16*d*, or inner space 16*c* if inner space 16*d* is shown, the user moves the tray along the longitudinal axis freeing the key from the guide and continuing until the pin engages the distal end of the rail. Depending on which side of the tray is disposed to be accessible, the travel distance may be the entire rail as illustrated in FIG. 1*a* or minimal as illustrated in FIG. 1*b*.

The user then pivots the tray to gain access to the desired inner space. To secure the tray, the user slide the tray until key

16*j* is restrainably engaged by guide 14*j*. To apply the cosmetic, the user can remove brushes from shelf 14*d*.

While the invention has been described in conjunction with specific embodiments, it is to be understood that many alternatives, modifications, and variations will be apparent to those skilled in the art in light of the foregoing description.

What is claimed is:

1. A compact for carrying a cosmetic, the compact comprising:

a base comprising a pair of hinge pins; and a tray comprising lateral sides and longitudinal sides, the tray having a first face opposed to a second face, the first face comprising a first storage space for storing a cosmetic and the second face comprising a second storage space for storing a cosmetic;

the tray comprising a pair of rails, each rail engaging a respective hinge pin of the pair of hinge pins;

wherein the pair of rails slides the tray relative to the base on the pair of hinge pins from a first longitudinal position to a second longitudinal position and vice versa, the second longitudinal position coinciding with a pivot point of the tray relative to the base;

wherein the tray pivots about the pivot point with respect to the base from a first lateral position to a second lateral position, the first lateral position making the first storage space accessible to a user and the second lateral position making the second storage space accessible to the user;

wherein the tray comprises a longitudinally oriented key for engaging the base in a longitudinal direction to secure the tray in the second lateral position; and a cover connected to the base by a common hinge oriented substantially parallel to the longitudinal direction of sliding of said tray.

2. The compact of claim 1, wherein the tray comprises a magnetized surface for removably storing a cosmetic having a metallic surface in contact with the magnetized surface.

3. The compact of claim 1, wherein the base comprises a bed for storing the tray.

4. The compact of claim 1, wherein said key is co-linear with said rail.

5. A compact for carrying a cosmetic, the compact comprising:

a cover and a base forming a casing; and a tray slideably and pivotably connected to the base, the tray having a first face opposed to a second face, the first face comprising a first storage space for storing a first cosmetic and the second face comprising a second storage space for storing a second cosmetic;

wherein the base comprises a pair of hinge pins and the tray comprises a pair of rails, each rail engaging a respective hinge pin of the pair of hinge pins for longitudinal and rotational movement relative to each other permitting the tray to be longitudinally movable and pivotable about a pivot point with respect to the base, wherein the first storage space is accessible to a user when the tray is in a first lateral position with respect to the base, and the second storage space is accessible to a user when the tray is pivoted from the first lateral position to a second lateral position with respect to the base;

wherein the tray slides relative to the base from a first longitudinal position to a second longitudinal position and vice versa, the second longitudinal position coinciding with the pivot point of the tray relative to the base;

wherein the tray comprises a longitudinally oriented key for engaging the base in a longitudinal direction to secure the tray in the second position; and wherein the cover is connected to the base by a common hinge oriented substantially parallel to the longitudinal direction of sliding of said tray.

6. The compact of claim 5, wherein the base comprises a bed for storing the tray when the casing is closed.

7. The compact of claim 6, wherein the bed is flanked by a pair of upright walls, the walls comprising a recess, tray comprises a key for being engageably received by the recess.

8. The compact of claim 5, wherein said key is co-linear with said rail.

9. A compact for storing a plurality of cosmetics, the compact comprising:

a tray for storing cosmetics in a first face and a second face opposed to the first face; and a base having a pair of hinge pins received by a respective rail of a pair of rails disposed in the tray, wherein the pair of rails slides the tray relative to the base on the pair of hinge pins from a first longitudinal position to a second longitudinal position and vice versa, the second longitudinal position coinciding with a pivot point of the tray relative to the base;

wherein the tray pivots about the pivot point with respect to the base from a first lateral position to a second lateral position, the first lateral position making the first face accessible to a user and the second lateral position making the second face accessible to the user;

wherein the tray comprises a longitudinally oriented key for engaging the base in a longitudinal direction to secure the tray in the second lateral position; and a cover connected to the base by a common hinge oriented substantially parallel to the longitudinal direction of sliding of said tray.

10. The compact of claim 9, wherein the cosmetics are removably stored.

11. The compact of claim 10 wherein a surface of each face is magnetized and the cosmetic comprises a metal surface in contact with the magnetized surface.

12. The compact of claim 9 further comprising a top for closing on the base.

13. The compact of claim 12, wherein the tray stores in a bed disposed in the base.

14. The compact of claim 9, wherein said key is co-linear with said rail.

* * * * *